United States Patent [19]

Rosén

[11] 4,396,205

[45] Aug. 2, 1983

[54] GOLF CART

[76] Inventor: Göran Rosén, Franz Grödelstrasse 5, Bad Nauheim, Fed. Rep. of Germany, 6350

[21] Appl. No.: 247,098

[22] Filed: Mar. 24, 1981

[30] Foreign Application Priority Data

Jan. 2, 1981 [EP] European Pat. Off. ..... 81200001

[51] Int. Cl.[3] ..... B62B 3/02

[52] U.S. Cl. ..... 280/646; 280/DIG. 2

[58] Field of Search ..... 280/646, 645, 641, 42, 280/38, 40, DIG. 6

[56] References Cited

U.S. PATENT DOCUMENTS

| | | | |
|---|---|---|---|
| 2,793,871 | 5/1957 | Stableford | 280/42 |
| 2,926,925 | 3/1960 | Ozlek | 280/42 |
| 3,489,426 | 1/1970 | Bond | 280/40 |
| 3,620,546 | 11/1971 | Anderson | 280/DIG. 6 |

FOREIGN PATENT DOCUMENTS

| | | | |
|---|---|---|---|
| 79743 | 12/1953 | Norway | 280/645 |
| 941603 | 11/1963 | United Kingdom | 280/DIG. 6 |
| 1228970 | 4/1971 | United Kingdom | 280/DIG. 6 |

*Primary Examiner*—Joseph F. Peters, Jr.
*Assistant Examiner*—Kenneth R. Rice
*Attorney, Agent, or Firm*—Holman & Stern

[57] ABSTRACT

A two-wheeled golf cart provided with a container intended for receiving the wheel undercarriage, the legs of which can be moved apart to operative position, and on which the container is arranged in weightless outbalanced condition, whereby the wheel undercarriage can be readily folded out of the container and retracted into it respectively by means of a simple handgrip only, and thereby being ready for immediate use. This task is solved thereby that the pull rod is designed as a two-armed lever, the shorter arm of which is adapted to act upon a first linkage system for causing the wheel undercarriage to be retracted into and folded out of the container respectively, a second linkage system being provided to be acted upon by the pull rod in order to act upon the wheel undercarriage, when this is in its folded-out position, for effecting that its legs, each of which carries a wheel, are moved apart and pulled together respectively.

9 Claims, 10 Drawing Figures

GOLF CART

BACKGROUND OF THE INVENTION

The present invention refers to a two-wheeled golf cart provided with a pull handle and a container subdivided into a plurality of compartments for receiving golf clubs, appurtenances etc. and for housing the wheel undercarriage and the wheels in their inactive position, the wheel undercarriage on one hand being attached to the container and on the other hand being thus arranged relative thereto, that the container is outbalanced when the wheel undercarriage is in its operative position whereby the free end of the pull handle is relieved from load.

Golf carts are known in different embodiments. They can be classified in two main groups; such which are outbalanced whereby the handle part of the pull rod is unloaded, and such which are more or less directly fixed to the club bag and therefore will load the pull handle considerably. The first type incorporates such golf carts which for achieving a better stability has a wheel undercarriage with legs that can be folded out laterally, which is very bulky also after the folding together, whereas under the second type fall carts with wheels that are detachable or retractable into the container. Beside the fact that these golf carts are not outbalanced, the mounting and dismounting of a convertible bag and cart is a complicated matter, which can be accomplished some times but not positively every time.

SUMMARY OF THE INVENTION

The purpose of the invention is to provide a golf cart which is free from the above drawbacks and which in itself combines the advantages of the two abovementioned types of carts, i.e. a wheel undercarriage the legs of which can be widely moved apart upon which the container is arranged to be outbalanced, whereby the wheel undercarriage by a simple hand grip can be retracted into and folded out of the container to be immediately ready for use. This task is achieved thereby that the pull rod is designed as a two-armed lever, the shorter arm of which is adapted during the first part of its pivotal movement to act upon a first linkage, whereby the wheel undercarriage is retracted into or folded out of the container resp. and that a second linkage system is arranged to be acted upon by the pull rod to actuate the wheel undercarriage during the second part of the pull rod pivotal movement, when the wheel undercarriage is in its folded-out position, for effecting that its legs, each of which is carrying a wheel, are laterally moved apart and pulled together respectively.

DESCRIPTION OF THE EMBODIMENTS

The golf cart according to the invention and shown in FIGS. 1–4 comprises a container 11, which is subdivided into a plurality of compartments, of which compartment 12 is intended for the wheel undercarriage and its operating mechanism, compartment 13 (FIG. 1) for the golf clubs and compartment 14 (FIG. 2) for appurtenances of different types.

Figure 1:
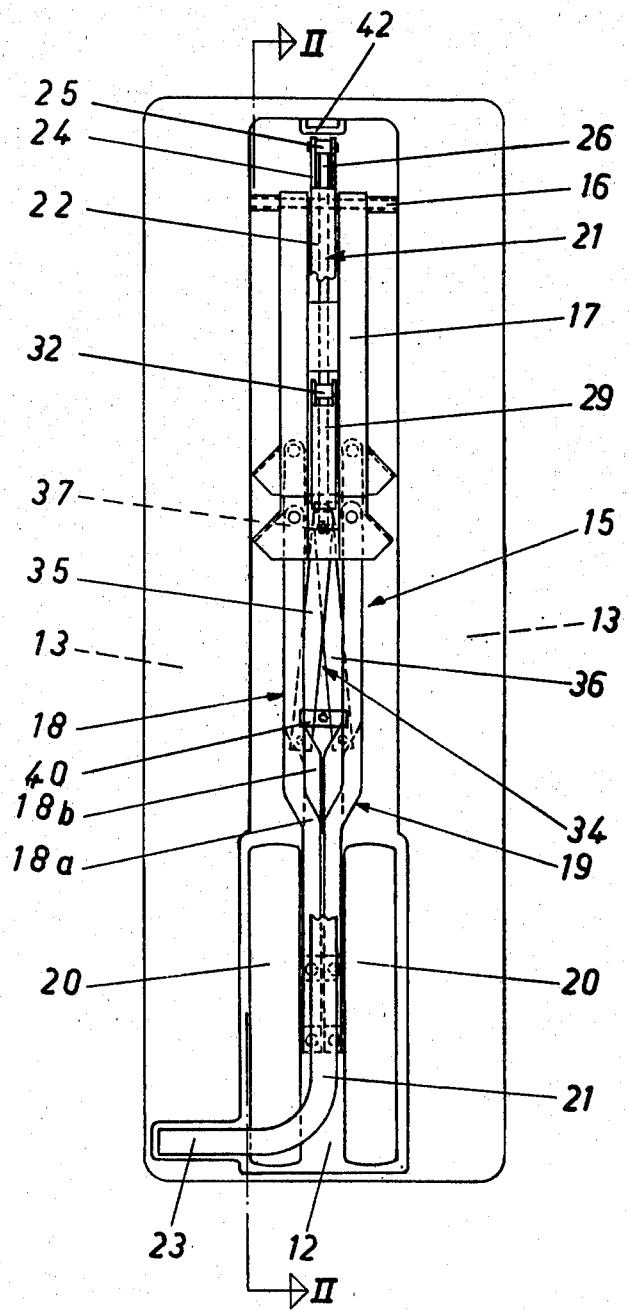
FIG. 1 shows a side view of a golf cart according to the invention in inactive position, i.e. with its wheel undercarriage retracted into the container.

The wheel undercarriage 15 shown in the compartment 12 in FIG. 1, consists of a frame 17, to which is articulatedly connected two legs 18 and 19 each one carrying a wheel 20. Each separate leg consists of a tie rod arrangement 18*a*, 18*b* and 19*a*, 19*b* respectively each of which is connected to the associated wheel thus that the wheels are always kept parallel to each other.

A pull rod 21 is supported on a shaft 16, which pull rod is arranged to extend along the upper part of the wheel undercarriage compartment and designed as a two-armed lever, the longer arm 22 of which being designed with a handle 23 at its free end, whereas its shorter arm 24 is provided with a pivot 25, to which is connected a rod 26 which can be subjected to traction and thrust. The rod 26 acts upon a first linkage 27 consisting of two articulated arms 28 and 29. One end of arm 28 is supported in a bracket 30 at a fixed wall portion 31 of the container, whereas the opposite end of the articulated arm 28 is pivotally connected to the second articulated arm 29, the opposite end of which is pivotably supported in the frame 17 of the wheel undercarriage. The articulated arm 29 is provided with an eccentric guide 32, which is displaceable in a slit 33 or the like in the articulated arm 29 and through which eccentric guide the above-mentioned rod 26 is freely displaceable. The other end of the rod 26 is articulatedly connected to a second linkage system 34, which incorporates the articulated arms 35 and 36. The pivotable connecting point 37 for the rod 26 is also a common pivot for the articulated arms 35 and 36 which are each one pivotably connected at their opposite ends to a leg 18 and 19 respectively.

The first linkage system 27 is acted upon by a pressure spring 38 which is compressed between a fixed stop 39 and the linkage system 27. For arresting the wheel undercarriage in inactive position the container 11 is provided with an easily detachable lock 40, and for arresting the wheel undercarriage in folded-out and moved-apart position there is attached a catch device 41 on the pull rod 21, which catch device can be brought in engagement with a catch 42 on the container.

Figure 2:
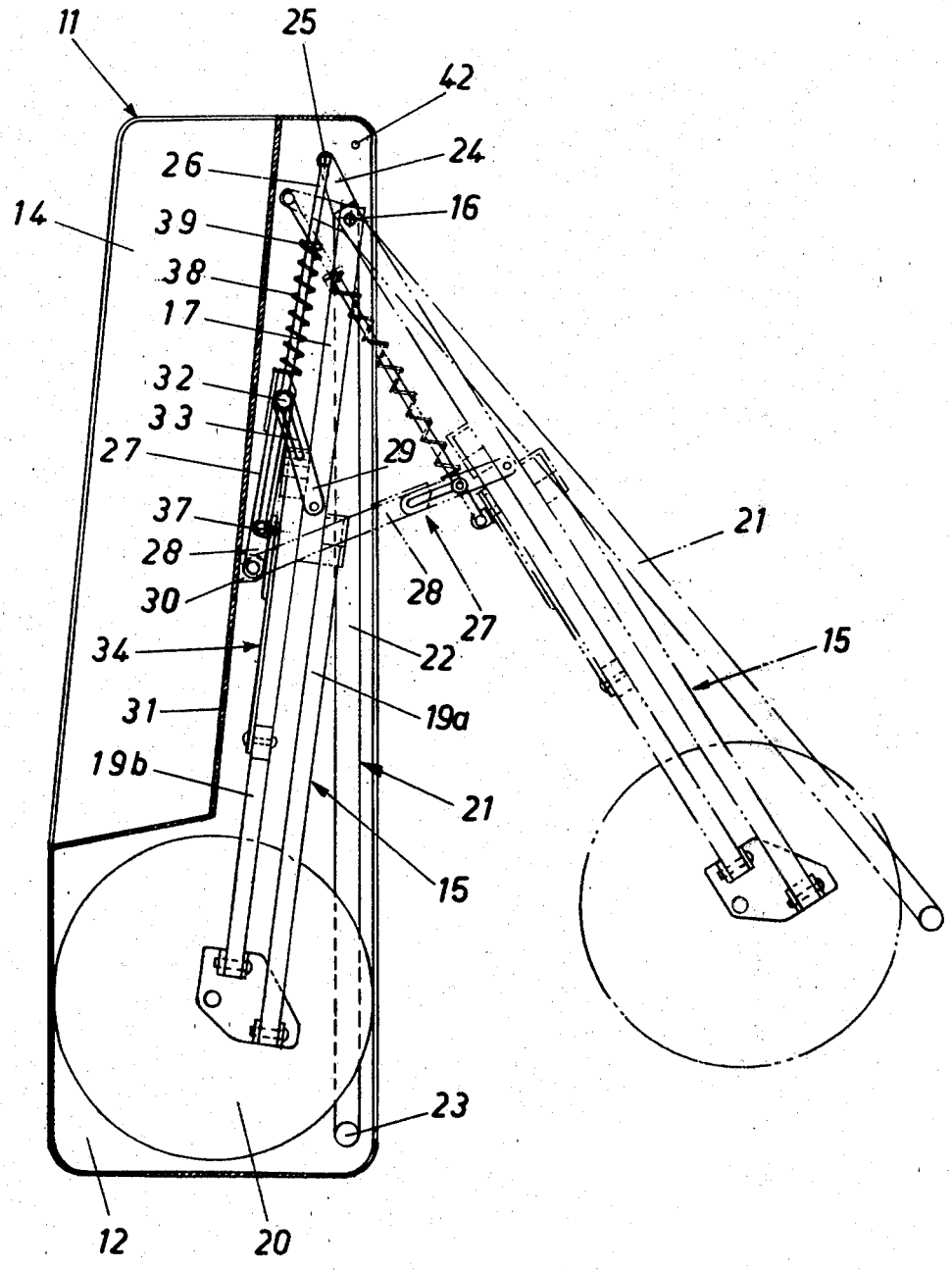
FIG. 2 is a longitudinal section along line II—II in FIG. 1 whereby the wheel undercarriage is also shown in dash-and-dot lines in folded-out position.
Figure 3:
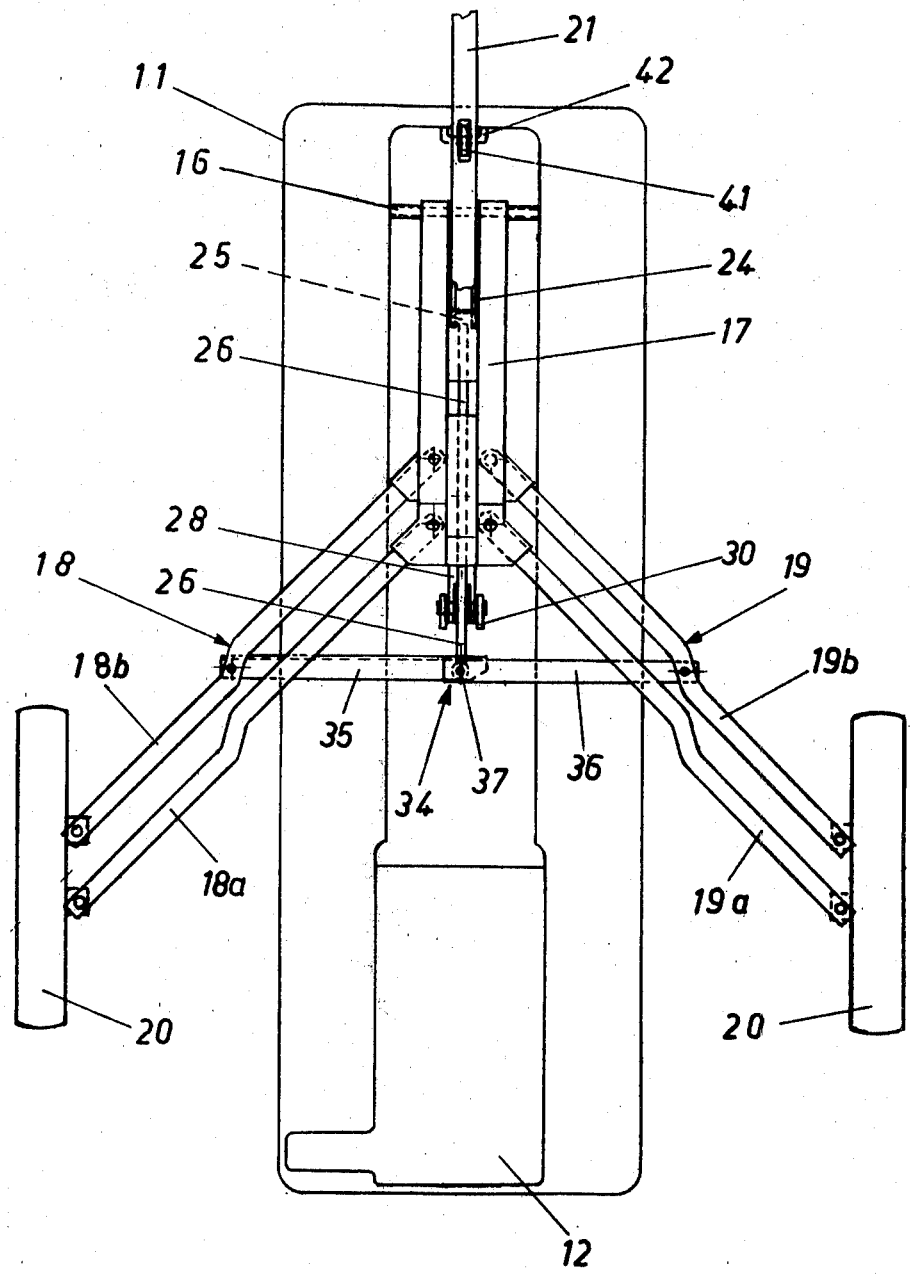
FIG. 3 shows a view similar to FIG. 1 but with the wheel undercarriage in folded-out and spread apart position according to FIG. 3.
Figure 4:
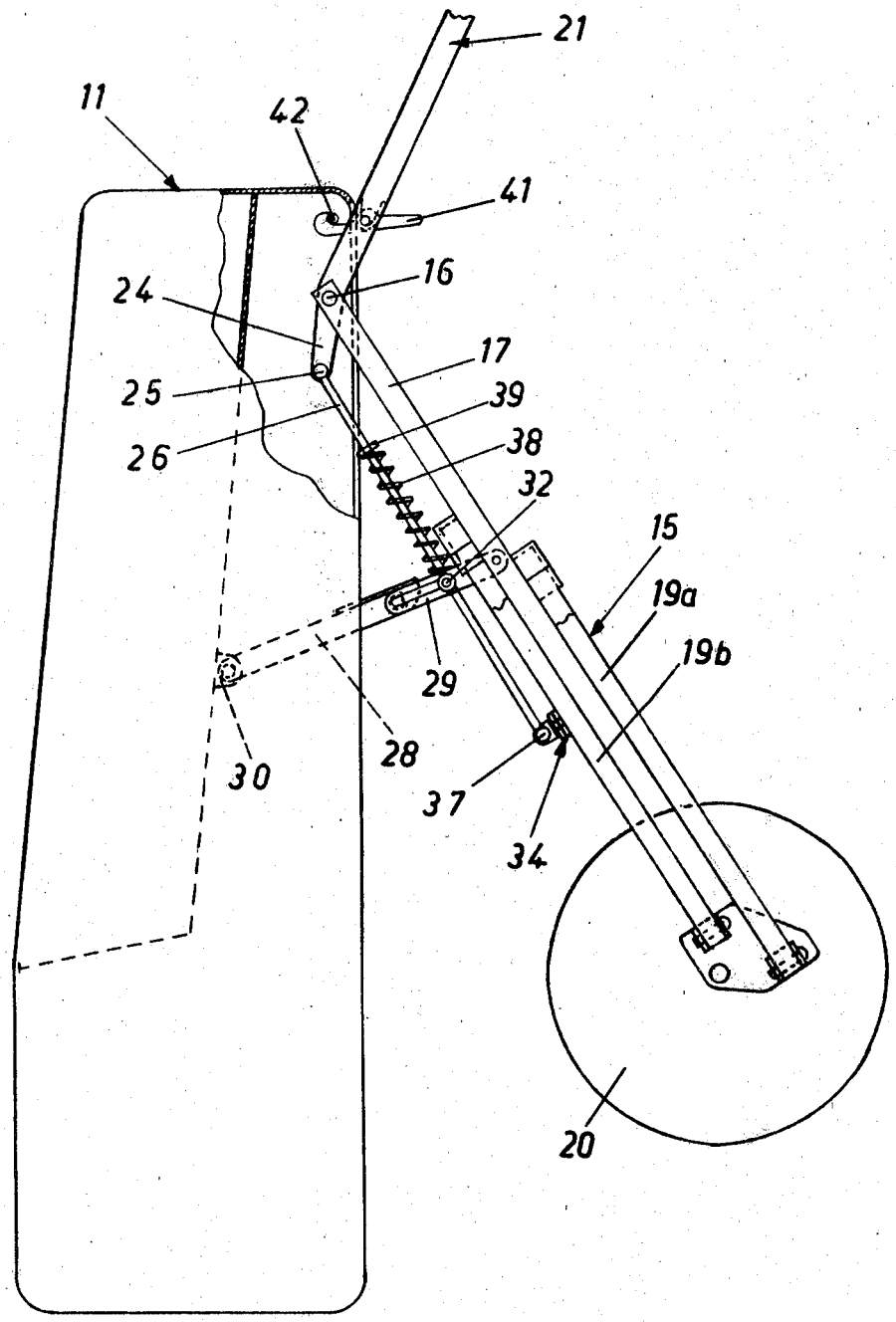
FIG. 4 is a side view partly in section of the golf cart in operative transport position.

If the wheel undercarriage 15 shall be pivoted from its inactive position shown in FIGS. 1 and 2 to operative transport position the catch device 40 is opened, whereby the entire wheel undercarriage due to the pressure from spring 38 will begin to rotate around the pivot 16 and swing out of the container 11. The spring pressure is chosen so that the linkage system 27 thereby unfolds completely, i.e. the link arms 28 and 29 will mainly form a straight line. By pivoting the pull rod 21 upwards to the position shown in FIGS. 3 and 4, the rod 26 is displaced against the wheels, whereby the second linkage system 34 will be acted upon, and the link arms 35, 36 and thereby also the legs 18 and 19 of the wheel undercarriage will be moved apart. At this movement of the pull rod the spring 38 is also compressed and presses thereby upon the linkage system 27 i.e. the link arm 29, whereby this will remain in its extended position.

The returning of the wheel undercarriage into the container is accomplished in the opposite manner. The pull handle 21 is first released from the catch 42 and it is then swung in a direction towards the wheels, whereby the legs 18, 19 are moved together and the spring 38 is relieved from load, whereby following a push on the wheel undercarriage in a direction towards the container the linkage system 27 bends inwards and the wheel undercarriage can be pivoted into the compartment 12 in the container. At this collapsing the spring 38 is again compressed and in order to prevent the wheel undercarriage from being swung out again the catch device 40 is activated. In order to facilitate the bending inwards of the first linkage system 27 it is advantageous that the link arms 28 and 29 when extended form together an obtuse angle, which shall differ only little from 180°.

In FIGS. 5–8 is shown a modified embodiment of the golf cart according to the invention, which differs from the embodiment according to FIGS. 1–4 mainly in the design of the operating mechanism for the wheel undercarriage movement.

Components and details in this embodiment similar to those in the previously described have been given the same reference numerals.

The golf cart shown in FIGS. 5–8 thus comprises a container or bag 11, subdivided in a number of compartments 12, 13 and 14 intended to house the wheel undercarriage 15 with wheels 20, golf clubs, appurtenences and the like.

Figure 5:
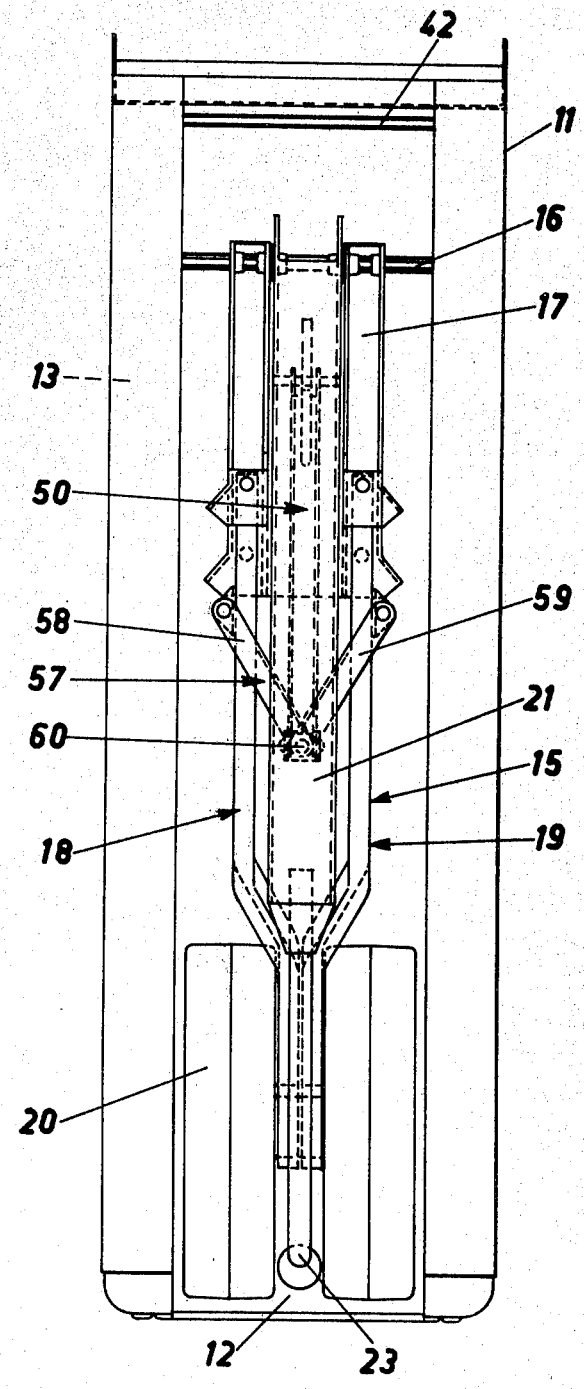
FIG. 5 is a side view corresponding to FIG. 1 and showing a modified embodiment of a golf cart according to the invention.

A shaft 16 is fitted to the upper part of the container 11, and pivotably supported thereon are the upper end of the wheel undercarriage frame 17 and the longer arm 22 of the pull rod 21. The pull rod is at its opposite end provided with a pull handle 23, which in collapsed position will be kept in the space between the wheels 20 in the compartment 12 as can be seen in FIG. 5.

The pull rod 21 comprises also in this case a longer arm 22 and a shorter arm 24 extending on the other side of said shaft 16 and being arranged to act upon a first link 51 of a first linkage system 50 of the operating mechanism of the wheel undercarriage of the cart.

Figure 6:
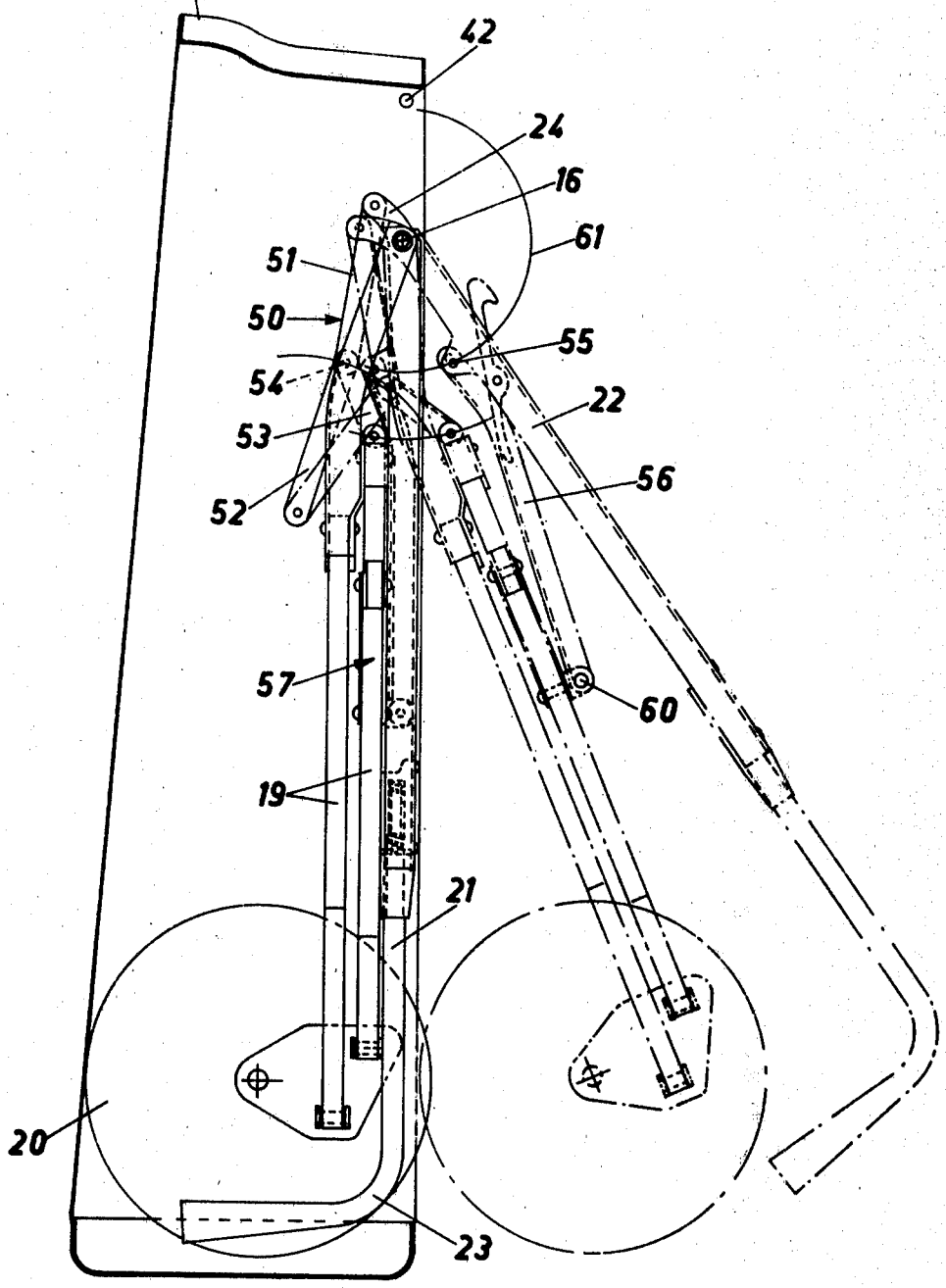
FIG. 6 shows a schematic section through the golf cart according to FIG. 5, with the wheels shown in their retracted, inactive position in continuous lines and in an intermediate position during its folding out of the container in phantom.
Figure 7:
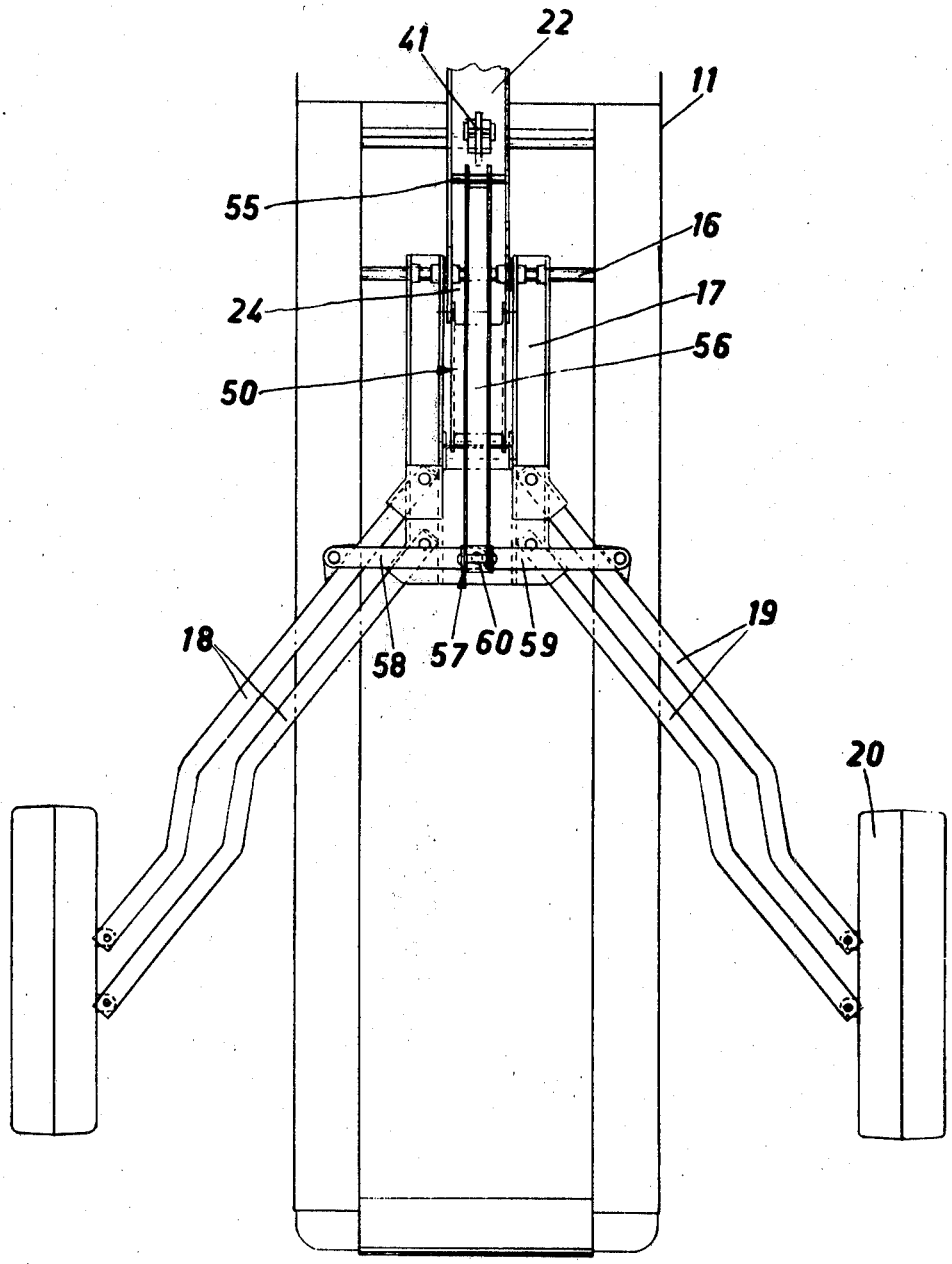
FIG. 7 is a view corresponding to FIG. 5 showing the wheel undercarriage in its active, folded-out position.
Figure 8:
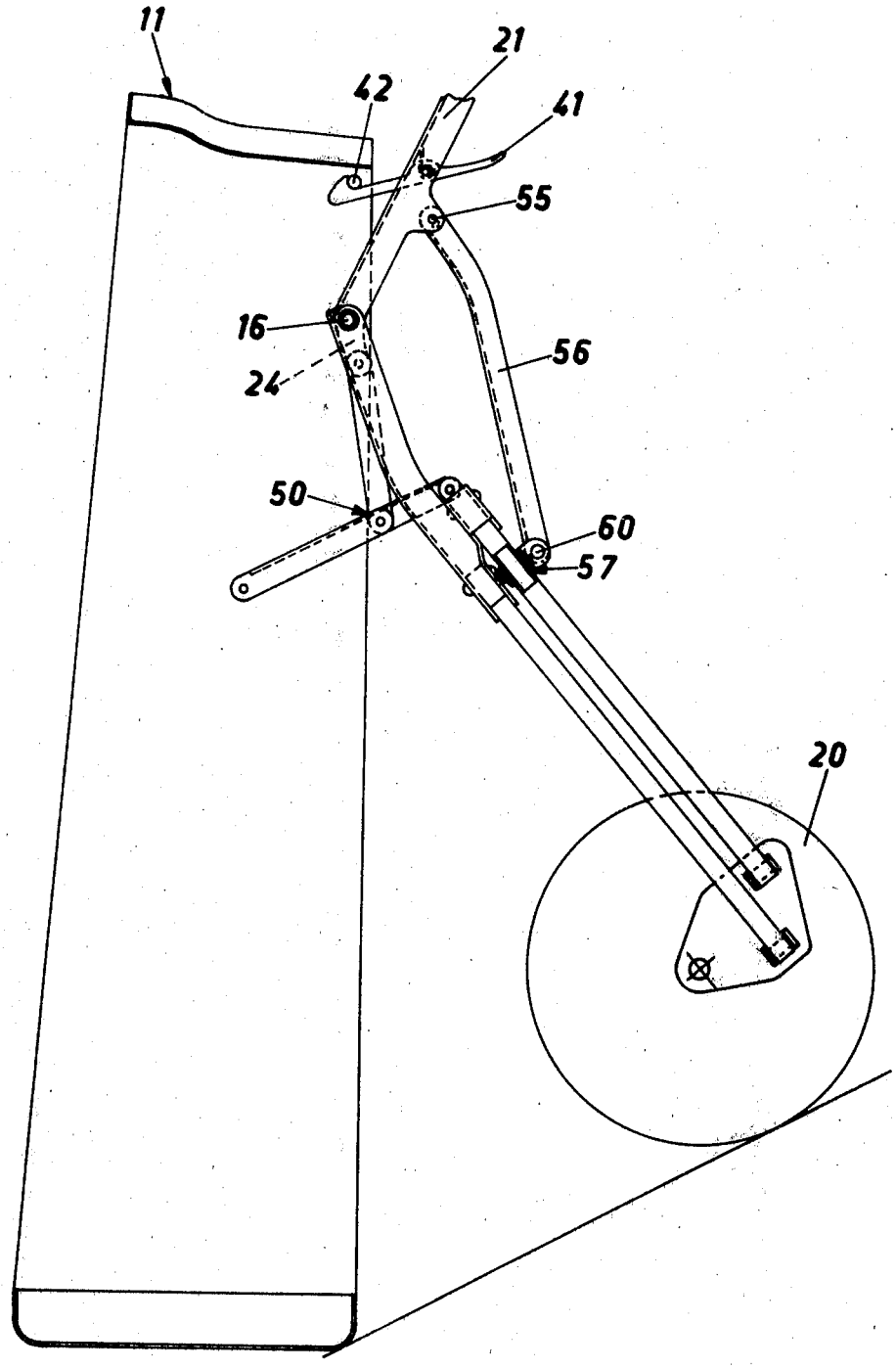
FIG. 8 is a side view partly in section of the golf cart with the wheel undercarriage in its active, entirely folded out position.

This first linkage system 50 is adapted to control the movement of the wheel undercarriage 16 into and out of the compartment 12 in the golf cart container 11 when acted upon by the pull rod, when this is moved from its inactive storing position between the wheels of the cart to its operative position completely extended and ready for use. The first linkage thus comprises three links 51, 52 and 53, which are all pivotably arranged about a common pivot 54. The opposite end of the first link 51 is as stated hereabove pivotably connected to the end of the shorter pull rod arm 24, whereas the second arm 52 is pivotably connected to a fixed point of the very container 11 and the third arm 53 is with its end opposed to the common pivot 54, pivotably connected to the frame 17 of the wheel undercarriage 15. The pivot 54 is thus "floating" and its position relative to the wheel undercarriage is determined by the actual position of the pull rod. In FIG. 6 is shown in continuous lines the position of the pivot 54 and the links 51, 52, 53 when the pull rod is situated in its retracted inactive position, whereas the figure shows in phantom the position of the same items when the pull rod has been swung out to an intermediate position. FIGS. 7 and 8 show views corresponding to FIGS. 5 and 6 in which the pull rod (of which only a part is shown) has been moved to its most extended position, i.e. the operative transport position.

The longer arm 22 of the pull rod 21 is provided with a pivot 55 on which is pivotably supported one end of a rod 56, the other end of which is pivotably connected to a second linkage system 57 intended to effect the lateral movement of the wheel-provided legs 18 and 19 of the wheel undercarriage, which lateral movement must however not be begun until the wheel undercarriage is swung out so far from its inactive rest position in the compartment 12, that the wheels 20 are completely free from the side walls of the container to make such lateral movement.

This second linkage system 57 comprises two link arms 58, 59 which are pivotable about a common pivot 60, to which the opposite end of rod 56 is likewise pivotably connected. The two link arms 58, 59 are with their ends turned from the common pivot 60 pivotably connected to one of the legs of the wheel undercarriage 15 each, and when the pull rod is swung around its pivot 16 this means that the rod 56 will act upon the common pivot 60, which will thereby be displaced resulting in the link arms 58, 59 being moved from the position shown in FIG. 5, where they form an acute angle together to the position shown in FIG. 7 where they are mainly aligned, in which position the legs 18, 19 of the wheel undercarriage are swung out as much as possible.

The movement of the pivot 55 on the longer pull rod arm 22 is begun immediately the pull rod is moved out from its rest position inside the compartment 12 and it is thereby moved along an arc-formed path 61, but this arc-formed path 61 is arranged thus that the pivot 55 during the first part of this movement is hardly increasing—or decreasing—its distance from the pivot, which means that the lateral movement of the wheel undercarriage legs 18 and 19 is not begun until the entire wheel undercarriage 15 has been folded out of the compartment 12, to the intermediate position shown with dash-and-dot lines in FIG. 6, which is effected by the shorter pull rod arm 24 acting upon the first linkage system 50 during the first part of the pull rod movement. During the second part of this movement the wheel undercarriage is then moved out to its position shown in FIG. 8, and the wheels 20 and their supporting legs 18, 19 are simultaneously moved apart to the position shown in FIG. 7, which position corresponds to FIG. 8.

The pull rod 21 is provided with a catch device 41 adapted to be hitched to a catch 42 arranged in the container to lock the golf cart in transport position.

Figures 9, 10:
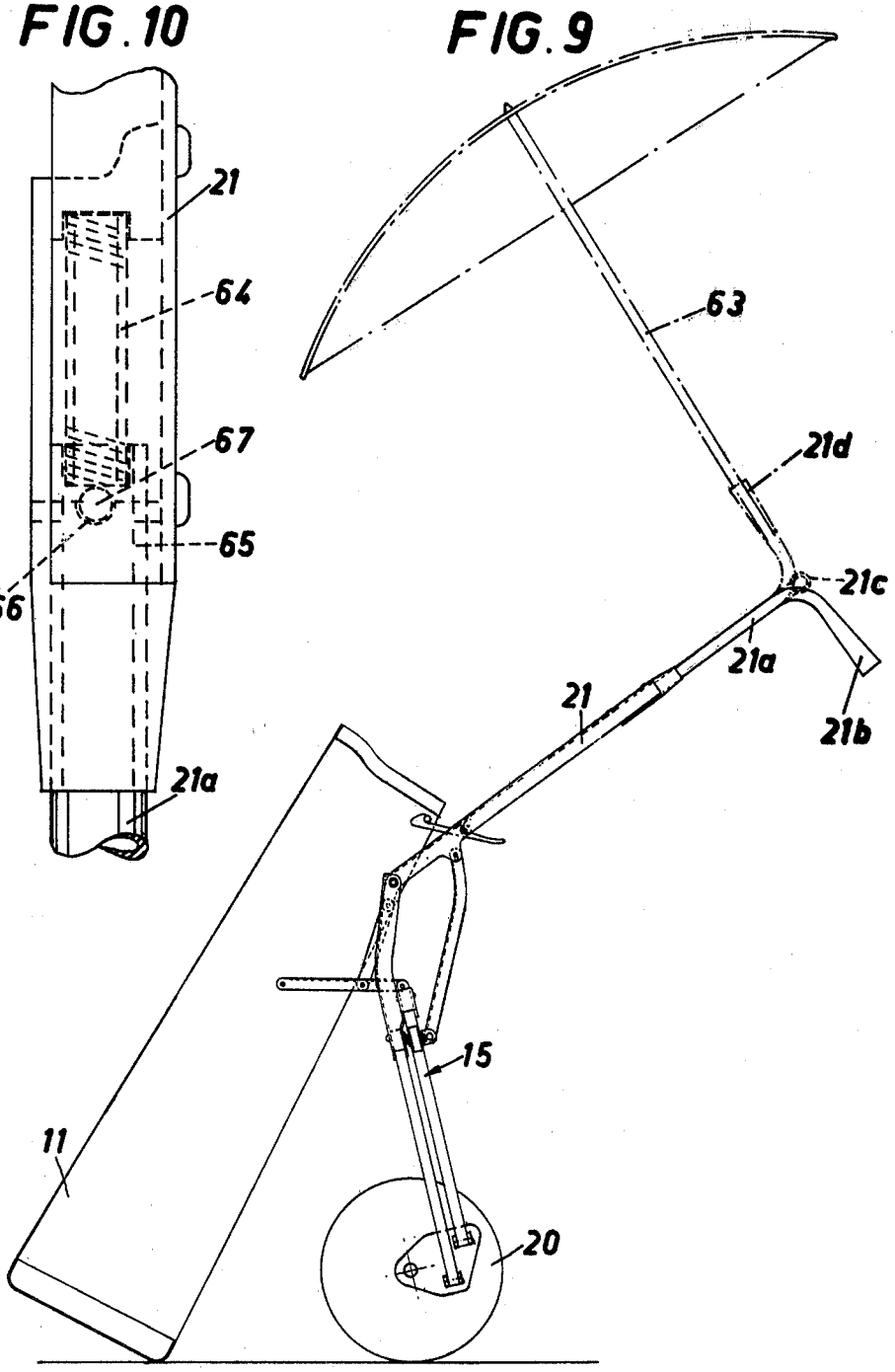
FIG. 9 shows in a side view the golf cart according to the invention in transport position with the wheel undercarriage in entirely folded-out position, and showing the pull handle in different index positions and with a possible umbrella mounted thereto.
FIG. 10 shows in a partial section a portion of the connection between the pull rod and its pull handle.

FIG. 9 of the drawings show in a side view schematically the golf cart according to FIGS. 5–8 in operative transport position. As shown in this figure the pull rod 21 has a pull handle part 21a which terminates in a handle 21*b* which is bent perpendicularly to the longitudinal direction of the pull rod. The handle part 21*a* is furthermore rotatable in relation to the pull rod, and for this purpose it is fitted to the pull rod 21 in a manner further shown and described in FIG. 10.

With this possibility of placing the pull handle 21*b* in different angular positions relative to the pull rod it is possible to place the perpendicular handle part 21*b* in the position most suitable for the need at any specific time. It could thus be desirable to have the handle 21*b* placed as shown in continuous lines, but it could also be appropriate to have the handle located as shown in dash lines at 21*c* for pulling the cart with a right hand or left hand grip, or as shown with dash-and-dot lines at 21*d* upwards whereby the tubular handle end can be used for fitting a sun-shade, an umbrella 63 or the like.

In FIG. 10 is finally shown a preferred embodiment of the rotatable connection between the pull rod 21 and its handle part 21*a*. The pull rod 21 is thus provided with a helical spring 64 arranged between a fixed stop and the end of the pull handle 21*a* which is connected to the pull rod. Adjacent the end of the pull rod 21 there is fitted a retainer 65 which at its inner end is provided with a number of semicircularly formed apertures 66. The pull handle which passes through this sleeve is at its end extending to the opposite side of the sleeve 65 equipped with a shaft 67 adapted to enter in diametrically opposed apertures 66 in the retainer 66. The spring 64 is adapted to press the pull handle 21*a* against the retainer thereby to retain the pull handle 21*b* in its occasional position in relation to the remainder of the pull rod. By the described construction it is achieved a simple and reliable possibility of indexing the handle merely by pushing the handle inwards whereby the spring action will be overcome and the shaft 67 will move away from the apertures and allow rotation of the pull handle 21*a* to the desired position whereupon the force on the pull handle can be released to allow the spring 64 to bring the shaft into engagement with the apertures again.

The invention is not limited to the embodiments shown and described, but it can be considerably varied within the scopes of the appended claims.

What I claim is:

1. A two wheeled golf cart having an active transport position and an inactive storage position, said cart including a container subdivided into a plurality of compartments for receiving golf clubs and golf appurtenances and for housing a retractable wheeled undercarriage for the cart when the cart is in inactive position, said wheeled undercarriage including a framework for supporting the container having a pair of wheeled legs articulated thereto so that the wheels are moveable between a moved-apart position and a pulled-together position, and an operating mechanism for said wheeled undercarriage including a first linkage system for retracting and folding out said undercarriage, a second linkage system for pulling together and moving apart the wheels, and a pull rod for operating both linkage systems comprising a two-armed lever having a shorter arm and a longer arm, said pull rod being pivotably associated with said operating mechanism so that from an inactive cart storage position initial pivotal movement of the pull rod functions to move the retracted undercarriage to a folded-out position and subsequent pivotal movement functions to move the wheels to a moved-apart active cart transport position wherein the pull rod is relieved from load.

2. The golf cart of claim 1, wherein the first linkage system includes a first pair of pivotably connected links attached at one free end to said container and at the other free end to said undercarriage so that when the undercarriage is retracted the links are at an acute angle and when the undercarriage is folded-out the links are in substantial linear alignment, and biasing means directly or indirectly responsive to pivotal movement of said pull rod for urging said links into linear alignment.

3. The golf cart of claim 2, wherein said first linkage system further includes connector means linked to the shorter arm of said pull rod for movement therewith, and said biasing means is responsive to the action of said connector means.

4. The golf cart of claim 3, wherein said connector means comprises a connecting rod and said biasing means comprises a spring coaxially disposed on said connecting rod so that movement of said connecting rod with pivotal movement of said pull rod compresses said spring to urge the first pair of links into substantial linear alignment.

5. The golf cart of claim 3, wherein the second linkage system includes a second pair of pivotably connected links pivotally attached at one free end thereof to one wheeled leg of the undercarriage and at the other free end thereof to the other wheeled leg of the undercarriage so that when the wheels are in pulled-together position the links are at an acute angle and when the wheels are in moved-apart position the links are in substantial linear alignment, and wherein said connector means further functions to bring said links into and out of substantial linear alignment with pivotal movement of said pull rod.

6. The golf cart of claim 5, wherein said connector means comprises a connecting rod linked at one end thereof to the shorter arm of the pull rod and said biasing means comprises a spring operatively associated with said rod so that movement of said pull rod and said connecting rod causes said spring to bias said first pair of links into substantial alignment, and wherein said connecting rod is linked at the other end thereof to the pivot point of the second pair of links so that initial pivotal movement of said pull rod actuates said connecting rod and spring to urge said first pair of links into substantial alignment to fold out said undercarriage and subsequent pivotal movement of said pull rod when actuates said connecting rod to bring said second pair of links into substantial alignment to move apart said wheels and place the cart in active transport position.

7. The golf cart of claim 6, wherein said first pair of links includes eccentric guide means for guiding said rod, and said rod is freely displaceable through said eccentric guide means.

8. A golf cart as claimed in claim 1 wherein the first linkage system comprises three links which are pivotable about a common pivot point, each line at its free end being linked to the container, to the shorter arm of the pull rod and to the wheel undercarriage, respectively, the link connected to the shorter arm of the pull rod being adapted during the movement of the pull rod to displace the common pivot point to fold out and retract the undercarriage.

9. A golf cart as claimed in claim 8 wherein the second linkage system comprises two pivotably interconnected links each of which is pivotably connected to one leg of the wheel undercarriage at the free end thereof; and a rod connecting the pivot for these two links and the longer arm of the pull rod, said rod being attached to the longer arm of the pull rod so that during the first part of the pivoting movement of the pull rod said second linkage system is not operated to move apart said wheels, whereas during the second part of the pivoting movement said second linkage system is operated to move apart the wheels.

* * * * *